US008247727B2

(12) United States Patent
Zhou et al.

(10) Patent No.: US 8,247,727 B2
(45) Date of Patent: Aug. 21, 2012

(54) ARC CHAMBER EMPLOYING A NUMBER OF GASSING INSERTS TO FORM A NUMBER OF GAS FLOW CIRCULATION PATHS AND ELECTRICAL SWITCHING APPARATUS INCLUDING THE SAME

(75) Inventors: Xin Zhou, Franklin Park, PA (US); Paul J. Rollmann, Brown Deer, WI (US); William E. Beatty, Jr., Brighton Township, PA (US); Robert W. Mueller, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 394 days.

(21) Appl. No.: 12/691,014

(22) Filed: Jan. 21, 2010

(65) Prior Publication Data

US 2011/0174781 A1 Jul. 21, 2011

(51) Int. Cl.
*H01H 33/02* (2006.01)

(52) U.S. Cl. ..... 218/157; 218/34

(58) Field of Classification Search ..... 218/15–26, 218/34, 155–158; 335/201
See application file for complete search history.

(56) References Cited

U.S. PATENT DOCUMENTS

| | | | | |
|---|---|---|---|---|
| 4,743,720 | A * | 5/1988 | Takeuchi et al. | 218/24 |
| 5,223,681 | A | 6/1993 | Buehler et al. | |
| 6,281,459 | B1 | 8/2001 | Munsch et al. | |
| 7,009,132 | B1 | 3/2006 | Shea et al. | |
| 7,094,986 | B2 | 8/2006 | Shea | |
| 7,138,597 | B2 | 11/2006 | Shea et al. | |
| 7,259,646 | B2 * | 8/2007 | Rab et al. | 218/25 |
| 7,358,840 | B1 | 4/2008 | Shea et al. | |
| 7,674,996 | B2 * | 3/2010 | Shea et al. | 218/34 |

FOREIGN PATENT DOCUMENTS

| | | |
|---|---|---|
| DE | 10 2007 053 636 B3 | 4/2009 |
| GB | 1 008 725 A | 11/1965 |
| GB | 2 054 963 A | 2/1981 |
| JP | 5 135680 A | 6/1993 |

OTHER PUBLICATIONS

European Patent Office, "Notification of Transmittal of the International Search Report and the Written Opinion of the International Searching Authority, or the Declaration", Jun. 21, 2011, 14 pp.

* cited by examiner

*Primary Examiner* — Amy Cohen Johnson
*Assistant Examiner* — Marina Fishman
(74) *Attorney, Agent, or Firm* — Eckert Seamans Cherin & Mellott, LLC; Kirk D. Houser

(57) ABSTRACT

An electrical switching apparatus includes separable contacts, an operating mechanism structured to open and close the separable contacts, and an arc chamber. The arc chamber includes a slot motor having a core and a housing with an opening therein, an arc chute, and a number of gassing inserts disposed in the opening of the housing. The number of gassing inserts and the housing are structured to form a number of gas flow circulation paths. The number of gas flow circulation paths are structured to drive an arc into the arc chute.

16 Claims, 7 Drawing Sheets

2

2

FIG. 5
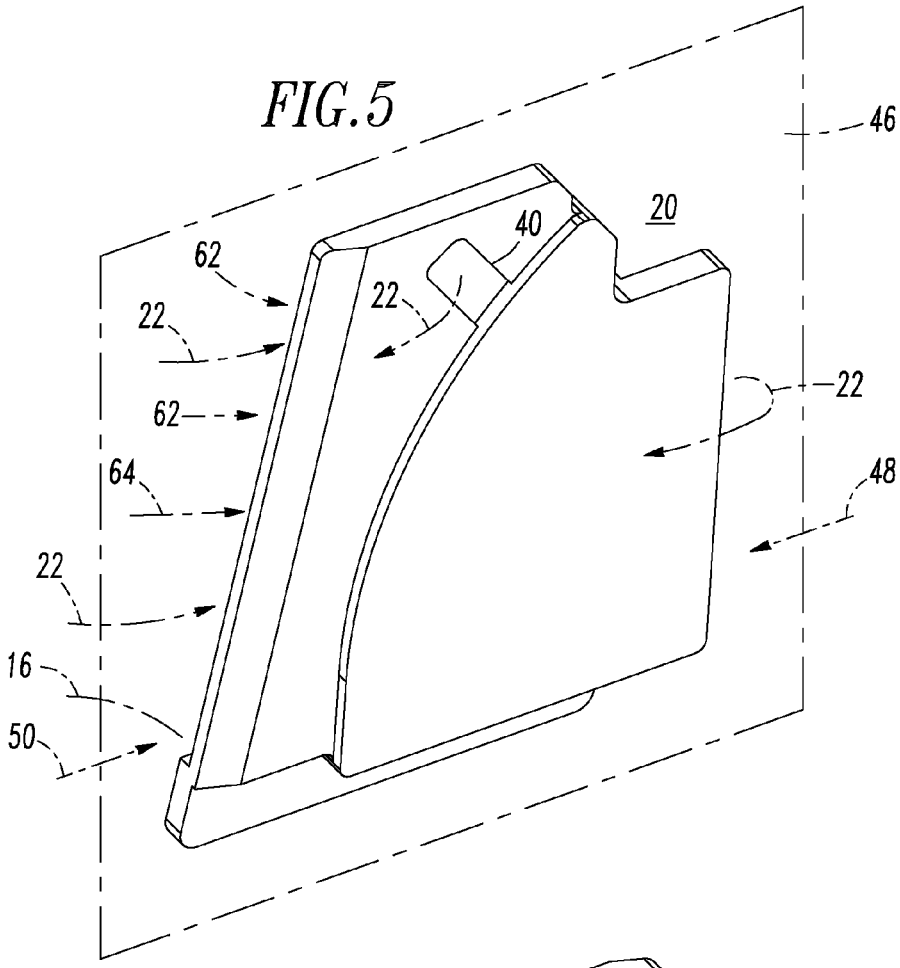
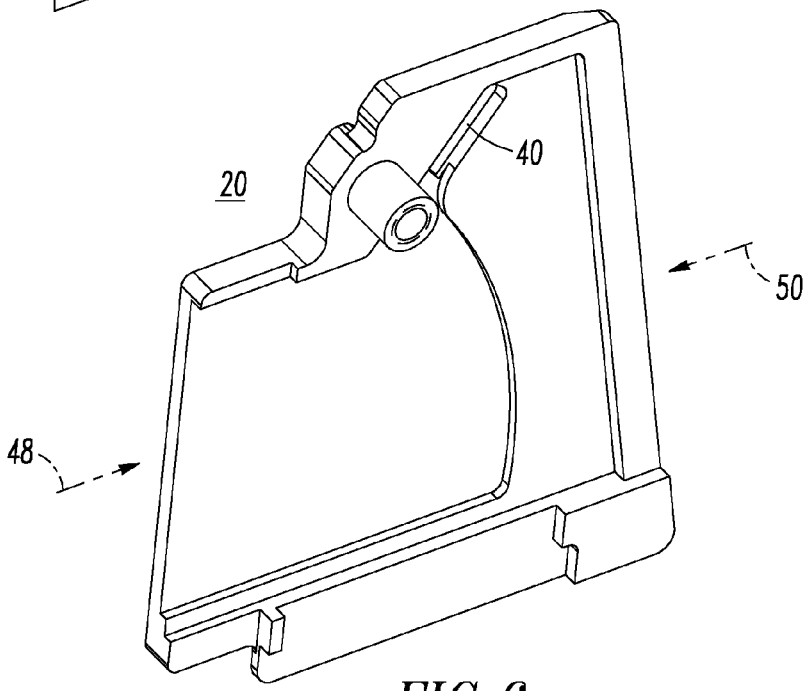
FIG. 6

ARC CHAMBER EMPLOYING A NUMBER OF GASSING INSERTS TO FORM A NUMBER OF GAS FLOW CIRCULATION PATHS AND ELECTRICAL SWITCHING APPARATUS INCLUDING THE SAME

BACKGROUND

1. Field

The disclosed concept pertains generally to electrical switching apparatus and, more particularly, to electrical switching apparatus including an arc chamber. The disclosed concept also pertains to arc chambers for electrical switching apparatus.

2. Background Information

Electrical switching apparatus in which separable contacts are exposed to air and are structured to open a power circuit carrying appreciable current typically experience arcing as the contacts separate. These electrical switching apparatus, such as for instance, circuit breakers, commonly incorporate arc chutes to help extinguish the arc. Such arc chutes typically comprise a number of electrically conductive plates held in spaced relation around the separable contacts by an electrically insulative housing. The arc transfers to the arc plates where it is stretched and cooled until extinguished. A considerable volume of gas is generated by the arc. The pressure generated by this arc gas must be relieved to avoid catastrophic damage to the electrical switching apparatus casing.

As arc chamber size gets relatively smaller and smaller, it becomes more and more difficult for electrical switching apparatus, such as circuit breakers, to interrupt short circuits at relatively high system voltages, such as for example and without limitation, 10 kA/600 VAC single-phase. The failure mode for this type interruption is due to either thermal or dielectric breakdown across the separable contact gap that leads to re-ignition of arcing after current zero.

There is room for improvement in electrical switching apparatus including an arc chamber.

There is also room for improvement in arc chambers for electrical switching apparatus.

SUMMARY

These needs and others are met by embodiments of the disclosed concept, which provide a number of gassing inserts and a number of gas flow circulation paths in an arc chamber to drive an arc into an arc chute.

In accordance with one aspect of the disclosed concept, an arc chamber comprises: a slot motor comprising a core and a housing having an opening therein; an arc chute; and a number of gassing inserts disposed in the opening of the housing, wherein the number of gassing inserts and the housing are structured to form a number of gas flow circulation paths, and wherein the number of gas flow circulation paths are structured to drive an arc into the arc chute.

The arc chute may comprise two side walls and a plurality of plates including a plurality of legs proximate the two side walls; and the number of gassing inserts may be structured to cover a portion of the plates proximate the two side walls, in order to prevent arc erosion of the legs.

One of the number of gas flow circulation paths may be structured to be directed toward one of a movable contact and a stationary contact, in order to reduce metal vapor concentration about a contact region between the movable contact and the stationary contact.

The housing of the slot motor may further have a first side and an opposite second side facing the first side; the number of gassing inserts may be a first gassing insert disposed at the first side of the housing and a second gassing insert disposed at the opposite second side of the housing; the first gassing insert and the first side of the housing may be structured to form a number of first gas flow circulation paths; and the second gassing insert and the opposite second side of the housing may be structured to form a number of second gas flow circulation paths.

The housing and the first and second gassing inserts may include a first end disposed away from the arc chute and an opposite second end disposed toward the arc chute; and each the number of first gas flow circulation paths and each of the number of second gas flow circulation paths may circulate back toward the arc chute from either the first end or may circulate back toward the arc chute from a vent on a corresponding one of the first and second gassing inserts, the vent being located between the first end and the opposite second end of the corresponding one of the first and second gassing inserts.

The housing and the first and second gassing inserts may include a first end disposed away from the arc chute and an opposite second end disposed toward the arc chute; some of the number of first gas flow circulation paths may be between the first gassing insert and the first side of the housing of the slot motor, and may be circulated back toward the arc chute in an opening between the first and second gassing inserts; and some of the number of second gas flow circulation paths may be between the second gassing insert and the opposite second side of the housing of the slot motor, and may be circulated back toward the arc chute in the opening between the first and second gassing inserts.

As another aspect of the disclosed concept, an electrical switching apparatus comprises: separable contacts; an operating mechanism structured to open and close the separable contacts; and an arc chamber comprising: a slot motor comprising a core and a housing having an opening therein, an arc chute, and a number of gassing inserts disposed in the opening of the housing, wherein the number of gassing inserts and the housing are structured to form a number of gas flow circulation paths, and wherein the number of gas flow circulation paths are structured to drive an arc into the arc chute.

The operating mechanism may comprise a movable contact arm; the separable contacts may comprise a movable contact carried by the movable contact arm and a stationary contact; and the number of gassing inserts may include a vent providing one of the number of gas flow circulation paths, the vent being located proximate the movable contact in an open position of the movable contact arm.

The separable contacts may comprise a movable contact and a stationary contact; and the number of gassing inserts may include a vent providing one of the number of gas flow circulation paths, the vent may be located proximate the stationary contact.

The number of gassing inserts may be two gassing inserts; the number of gas flow circulation paths may be a first gas flow circulation path and a second gas flow circulation path; the arc chute may comprise two side walls and a plurality of plates including a plurality of legs proximate the two side walls; and the two gassing inserts may be structured to cover a portion of the plates proximate the two side walls, in order to prevent arc erosion of the legs.

BRIEF DESCRIPTION OF THE DRAWINGS

A full understanding of the disclosed concept can be gained from the following description of the preferred embodiments when read in conjunction with the accompanying drawings in which:

FIGS. 5 and 6 are isometric views of the gassing inserts of FIG. 1.

DESCRIPTION OF THE PREFERRED EMBODIMENTS

As employed herein, the term "number" shall mean one or an integer greater than one (i.e., a plurality).

The disclosed concept is described in association with a three-pole circuit breaker, although the disclosed concept is applicable to electrical switching apparatus having any number of poles.

Figure 1:
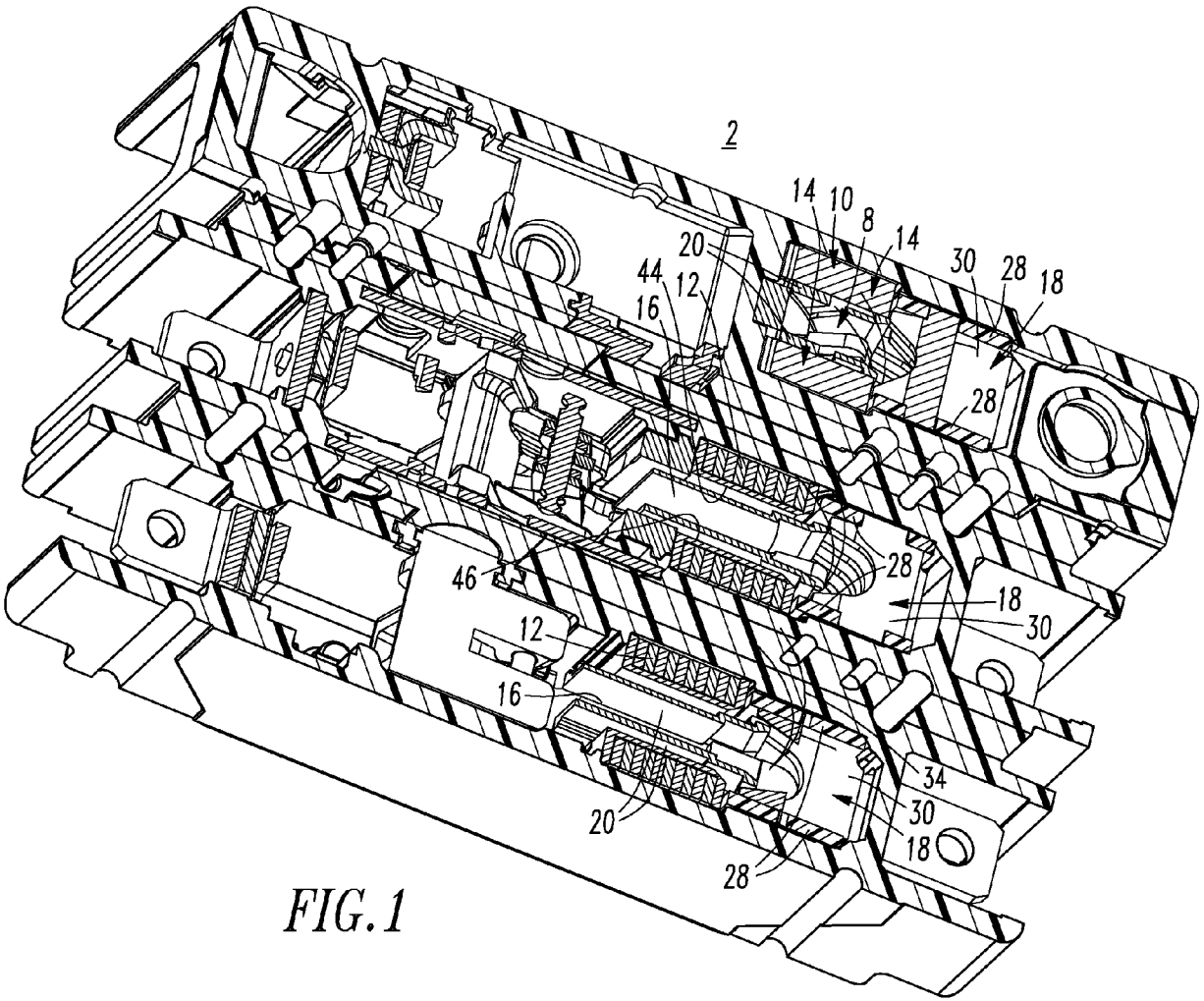
FIG. 1 is an isometric view of a three-pole circuit breaker, with the cover removed to show internal structures and with different cross sections being shown for each of the poles, in accordance with embodiments of the disclosed concept.
Figure 2:
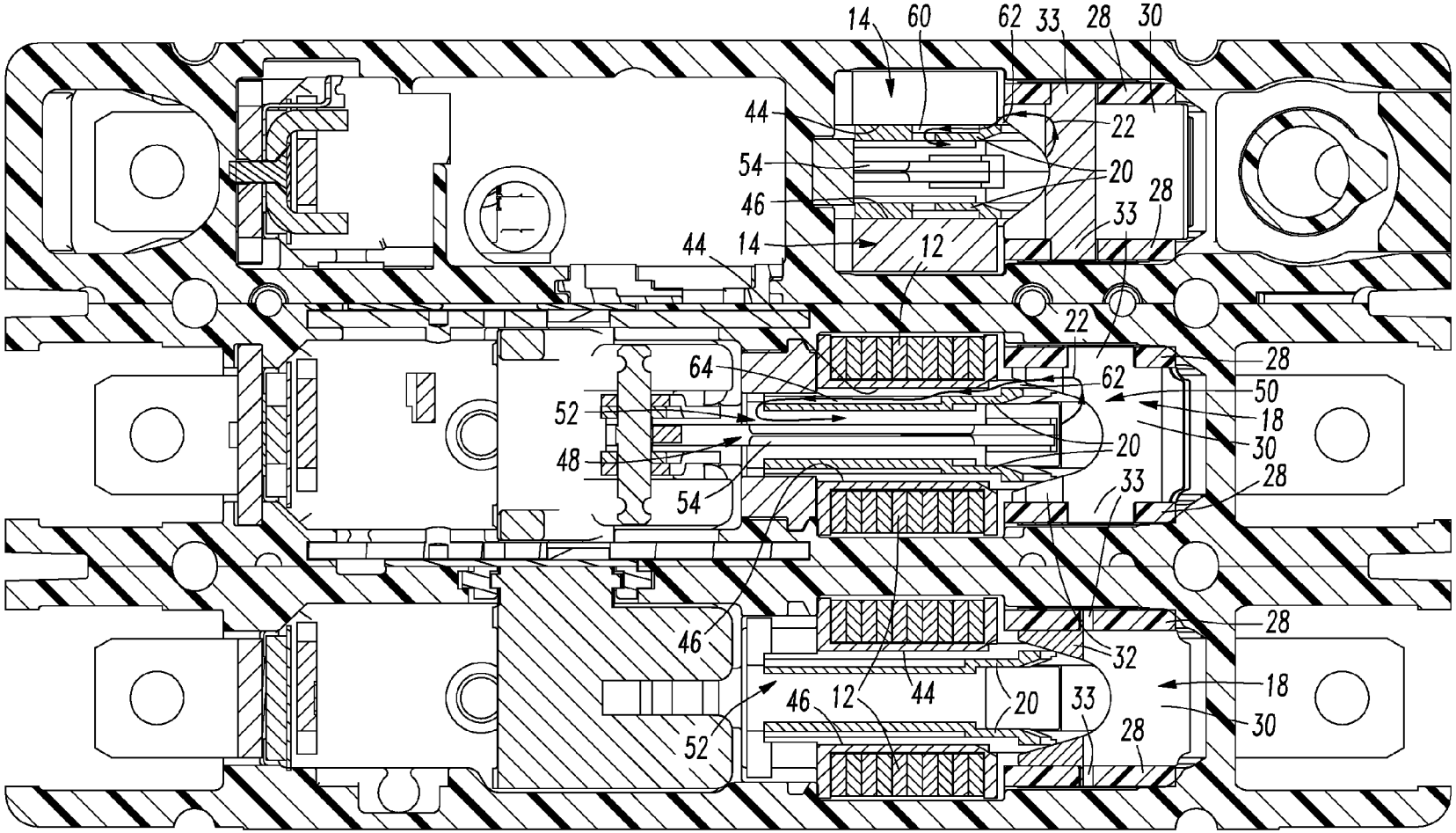
FIG. 2 is a plan view of the three-pole circuit breaker of FIG. 1.
Figure 7:
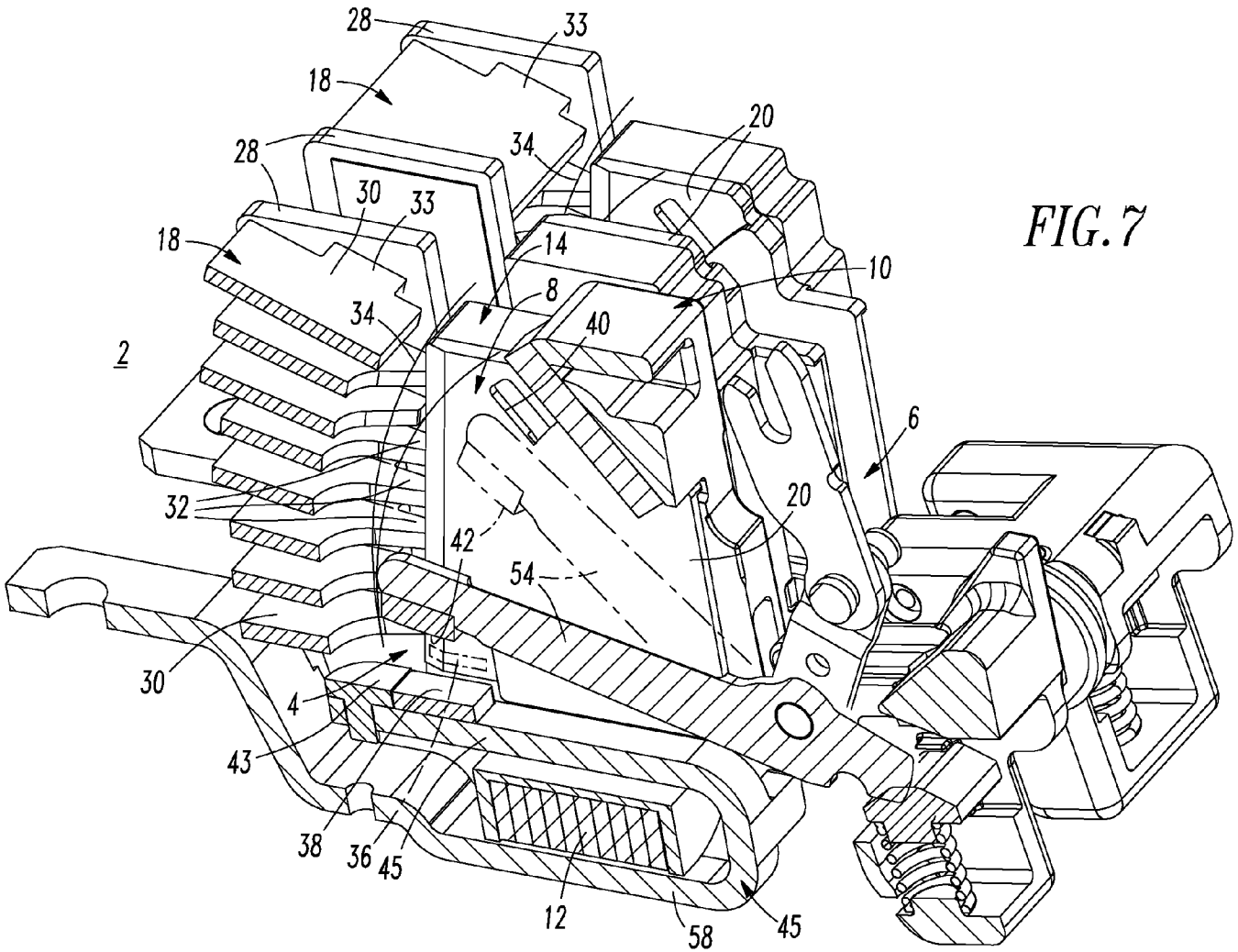
FIG. 7 is a cross sectional view along lines 7-7 of FIG. 3 showing the full elevation of each of the slot motors.

Referring to FIGS. 1, 2 and 7, an electrical switching apparatus, such as the example three-pole circuit breaker 2, includes separable contacts 4 (shown in FIG. 7), an operating mechanism 6 (shown in FIG. 7) structured to open and close the separable contacts 4, and an arc chamber 8. The arc chamber 8 includes a slot motor 10 having a core 12 and a housing 14 with an opening 16 therein, an arc chute 18, and a number of gassing inserts 20 disposed in the housing opening 16. The number of gassing inserts 20 (e.g., two example gassing inserts 20 are shown with each pole) and the housing 14 are structured to form a number of gas flow circulation paths 22 (e.g., two example gas flow circulation paths 22 are shown with each gassing insert 20), which are structured to drive an arc into the arc chute 18.

Figure 8:
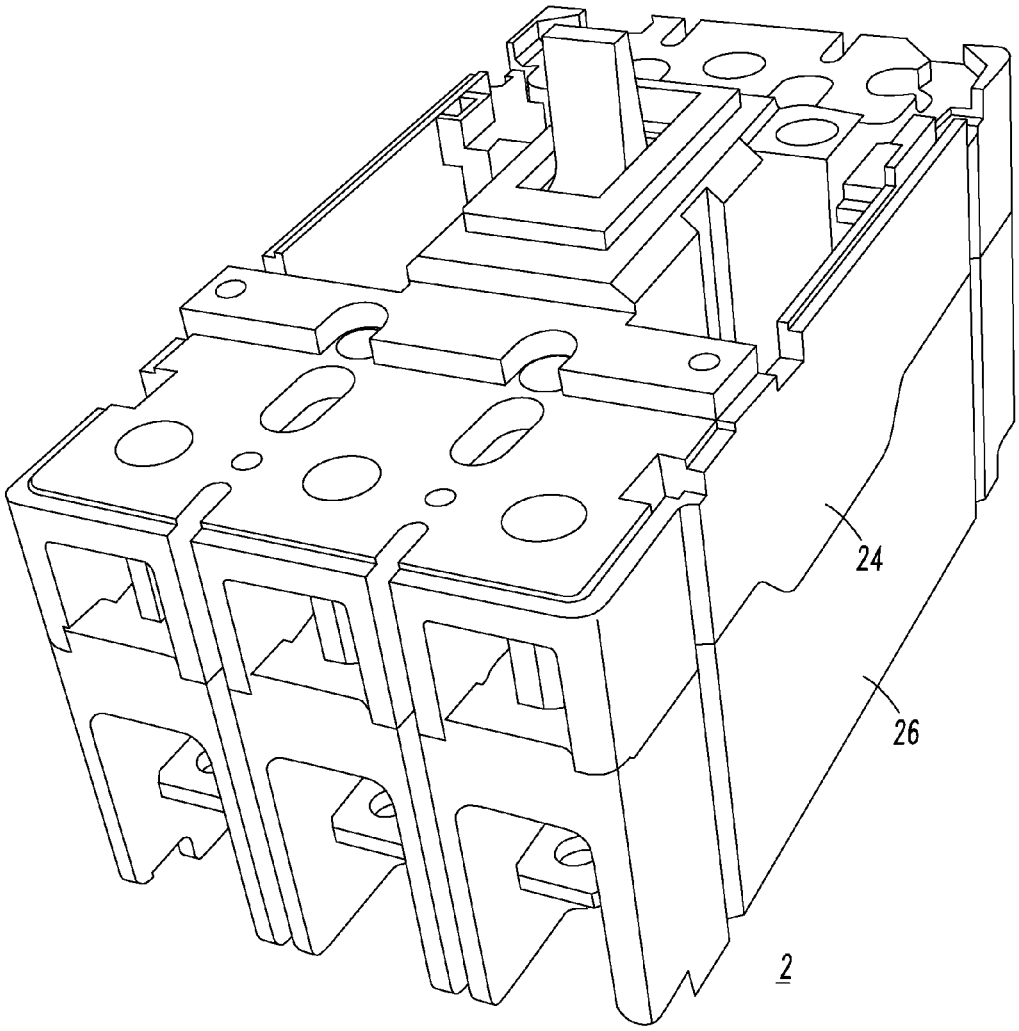
FIG. 8 is an isometric view of the circuit breaker of FIG. 1.

In FIGS. 1 and 2, the upper phase (with respect to FIGS. 1 and 2) has a relatively higher (with respect to FIG. 1) cross section, and the lower two phases (with respect to FIGS. 1 and 2) have relatively lower (with respect to FIG. 1) cross sections. The circuit breaker cover 24 and base 26 are shown in FIG. 8.

Although two example gassing inserts 20 are shown with each pole, it will be appreciated that at least one gassing insert 20 can be employed with each pole. Also, although two example gas flow circulation paths 22 are shown with each gassing insert 20, it will be appreciated that at least one gas flow circulation path 22 can be employed with each gassing insert 20.

Example 1

The number of gassing inserts 20 can preferably be made of a suitable material that will outgas relatively strongly when it interacts with arc plasma, such as, for example and without limitation, cellulose filled melamine formaldehyde (CMF).

Example 2

Figure 3:
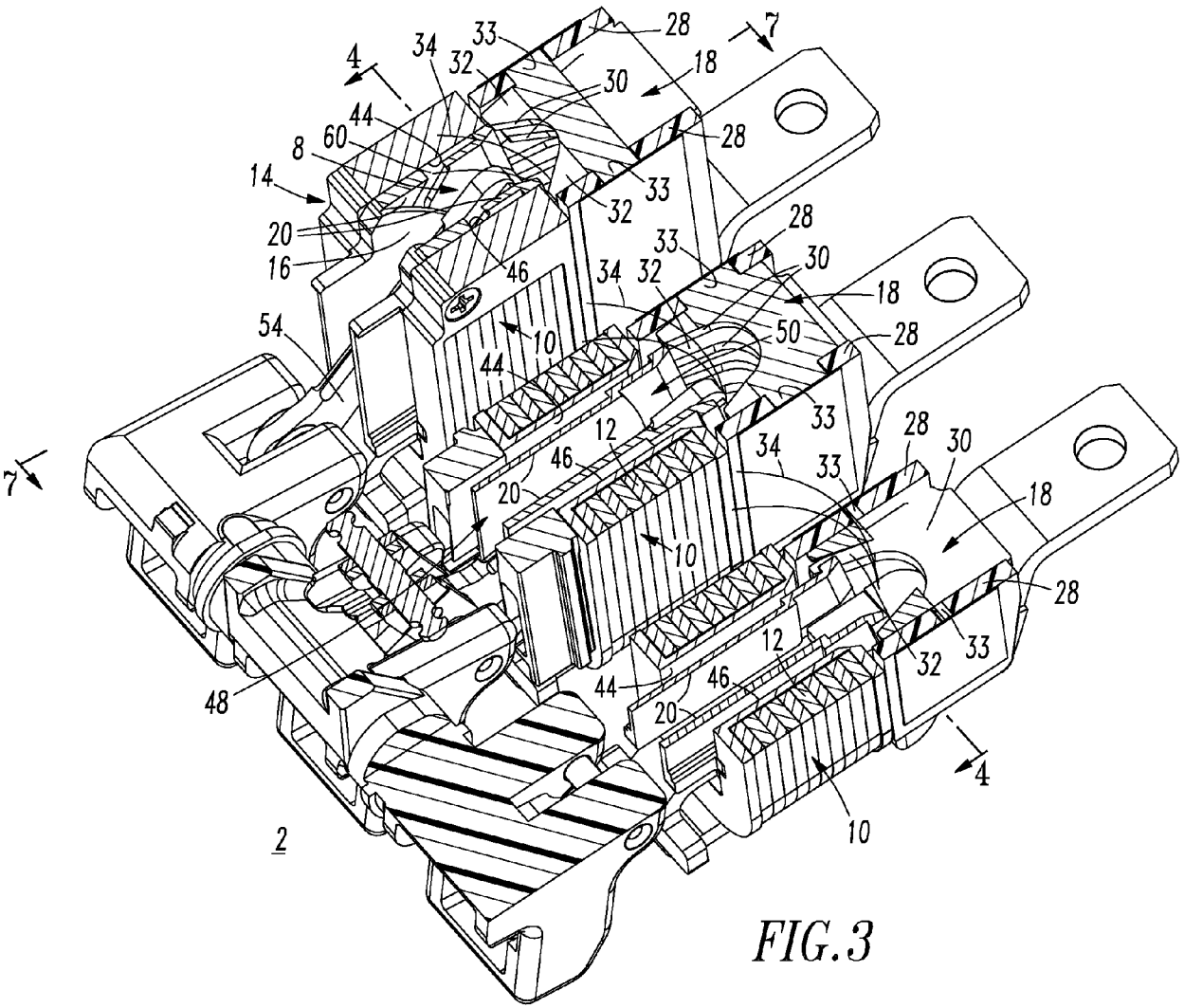
FIG. 3 is an isometric view of the circuit breaker of FIG. 1 with the base not shown to show internal structures.

As best shown in FIGS. 2 and 3, the arc chute 18 includes two insulative side walls 28 and a plurality of conductive, U-shaped arc plates 30 including a plurality of legs 32 (two example legs 32 are shown) proximate the two side walls 28. The number of gassing inserts 20 can be structured to cover a portion of the arc plates 30 proximate the two side walls 28, in order to prevent arc erosion of the two legs 32. For example, as will be explained, the arc 34 (FIG. 3) is directed toward the central portion of the arc chute 18, which is intermediate the two side walls 28, and is directed toward the inner U-shaped portion of the arc plates 30. The arc plates 30 also include plural legs 33 that engage the two side walls 28.

Example 3

As best shown in FIG. 2, two example gassing inserts 20 are employed per pole, although it will be appreciated that this could be a single structure (e.g., without limitation, two gassing inserts having a common base (not shown)), or could be a single gassing insert. The two example gassing inserts 20 each provide a first gas flow circulation path 22 (as shown with the upper (with respect to FIG. 2) pole) and a second gas flow circulation path 22 (as shown with the center (with respect to FIG. 2) pole). The two example gassing inserts 20 are disposed on each side of the slot motor housing 14 and are each structured to form the two example gas flow circulation paths 22 with a corresponding surface of the slot motor housing 14. The arc chute plates 30 are arranged in such a way that they not only allow effective gas flow through the back side (e.g., toward the right with respect to FIG. 2) of the arc chute 18, but also prevent arc shorting behind (e.g., further toward the right with respect to FIG. 2) the arc chute 18.

The two example gassing inserts 20 advantageously reduce metal vapor concentration and facilitate relatively quick dielectric recovery about the contact region of the separable contacts 4 as shown in FIG. 7.

The gassing inserts 20 further reduce metal vapor coming from the erosion of the arc plate legs 32. This is a result of the gas flow recirculation as provided by the two gas flow circulation paths 22. These paths 22 drive the arc 34 (FIG. 3) into the arc chute 18. The vent 36 (shown in phantom line drawing in FIG. 7) is located near the stationary contact 38. Alternatively, the vent 40 (FIG. 7) is near the fully open position (as shown in phantom line drawing) of the movable contact 42 (as shown solid in a partially open position in FIG. 7). Hence, the vent 40 is located proximate the movable contact 42 in an open position thereof, such as when it is fully blown open. The vent 36 is preferably located right next to the stationary contact 38, or can advantageously be located at other strategic locations that help to significantly increase the dielectric recovery after current zero for better interruption. The example vents 36,40 reduce metal vapor concentration and facilitate relatively quick dielectric recovery about the contact region between the movable contact 42 and the stationary contact 38.

Example 4

As shown in FIG. 3, the slot motor housing 14 has a first side 44 and an opposite second side 46 facing the first side 44. One of the two example gassing inserts 20 is disposed at the first side 44 and the other gassing insert 20 is disposed at the opposite second side 46. The first gassing insert 20 and the first side 44 form two example gas flow circulation paths 22, and the other gassing insert 20 and the opposite second side 46 form a mirror image of the two example gas flow circulation paths 22.

Example 5

As shown in FIGS. 2 and 3, the slot motor housing 14 and the two example gassing inserts 20 include a first end 48 disposed away from the arc chute 18 and an opposite second end 50 disposed toward the arc chute 18. Each of the gas flow circulation paths 22 circulates back toward the arc chute 18 from either the first end 48 or circulates back toward the arc chute 18 from one of the vents 36,40 on a corresponding one of the gassing inserts 20. Such vents 36 or 40 are located between the first end 48 and the opposite second end 50 of the corresponding one of the gassing inserts 20.

Example 6

Some of the example gas flow circulation paths 22 may be between the first gassing insert 20 and the first side 44 of the slot motor housing 14 and circulate back toward the arc chute 18 in an opening 52 between the two gassing inserts 20 for each pole. Some of the example gas flow circulation paths 22 are between the second gassing insert 20 and the opposite second side 46 of the slot motor housing 14 and circulate back toward the arc chute 18 in the opening 52 between the two gassing inserts 20.

Example 7

The gassing inserts 20 and the slot motor housing 14 provide an internal gas flow circulating path and relatively more cooling surface area to facilitate relatively stronger gas flow and relatively more cooling of arc plasma. This allows the relatively high temperature arc plasma generated across the separable contacts 4 to flow through the gas flow circulation paths 22, be cooled by the gassing inserts 20 and the surfaces of the slot motor housing 14, and circulate back from the back (toward the left with respect to FIGS. 1 and 2) of the arc chamber 8 and/or from the side vent 36 or 40 on the gassing inserts 20.

Example 8

The operating mechanism 6 includes a movable contact arm 54. The separable contacts 4 include the movable contact 42 carried by the movable contact arm 54 and the stationary contact 38. Both of the two example gas flow circulation paths 22 are directed toward at least one of the movable contact 42 and the stationary contact 38, in order to reduce metal vapor concentration and facilitate relatively quick dielectric recovery about the contact region between the movable contact 42 and the stationary contact 38. As is conventional, an arc runner 43 is disposed adjacent the stationary contact 38 at one end of a U-shaped conductor 45. The arc runner 43 is proximate the plates 30 of the arc chute 18.

Example 9

The example gas flow circulation paths 22 are first directed away from the separable contacts 4 and the arc chute 18, between the gassing inserts 20 and the surfaces of the slot motor housing 14, and then are circulated back toward the separable contacts 4 and the arc chute 18.

Example 10

The first gas flow circulation path 22 is first directed away from the separable contacts 4 and the arc chute 18, between a corresponding one of the two gassing inserts 20 and a corresponding one of the sides 44,46 of the slot motor housing 14, and then is circulated back from the end 48 toward the separable contacts 4 and the arc chute 18.

The second gas flow circulation path 22 is first directed away from the separable contacts 4 and the arc chute 18, between a corresponding one of the two gassing inserts 20 and a corresponding one of the sides 44,46 of the slot motor housing 14, and then is circulated back from the vent 36 or 40 toward the separable contacts 4 and the arc chute 18.

Example 11

At least one of the gas flow circulation paths 22 is circulated back toward the separable contacts 4 and the arc chute 18 in the opening 52 between the two gassing inserts 20.

At least one of the gas flow circulation paths 22 is circulated back toward the arc chute 18 in the opening 52 between the two gassing inserts 20.

Example 12

The movable contact arm 54 is movable within the opening 52 between the two example gassing inserts 20 and has a width of about 0.080 inch, in order to increase speed of movement thereof to improve current limiting and to reduce arc energy inside the arc chamber 8 during opening of the separable contacts 4. Hence, the movable contact arm 54 is relatively thinner, in order that it moves relatively faster to provide some current limiting to reduce such arc energy.

Example 13

Both of the movable contact arm 54 and a stationary conductor 58 are preferably coated with a suitable arc-proof insulating paint (e.g., without limitation, arc-proof epoxy coating paint, such as Limitrack™).

Example 14

Figure 4:
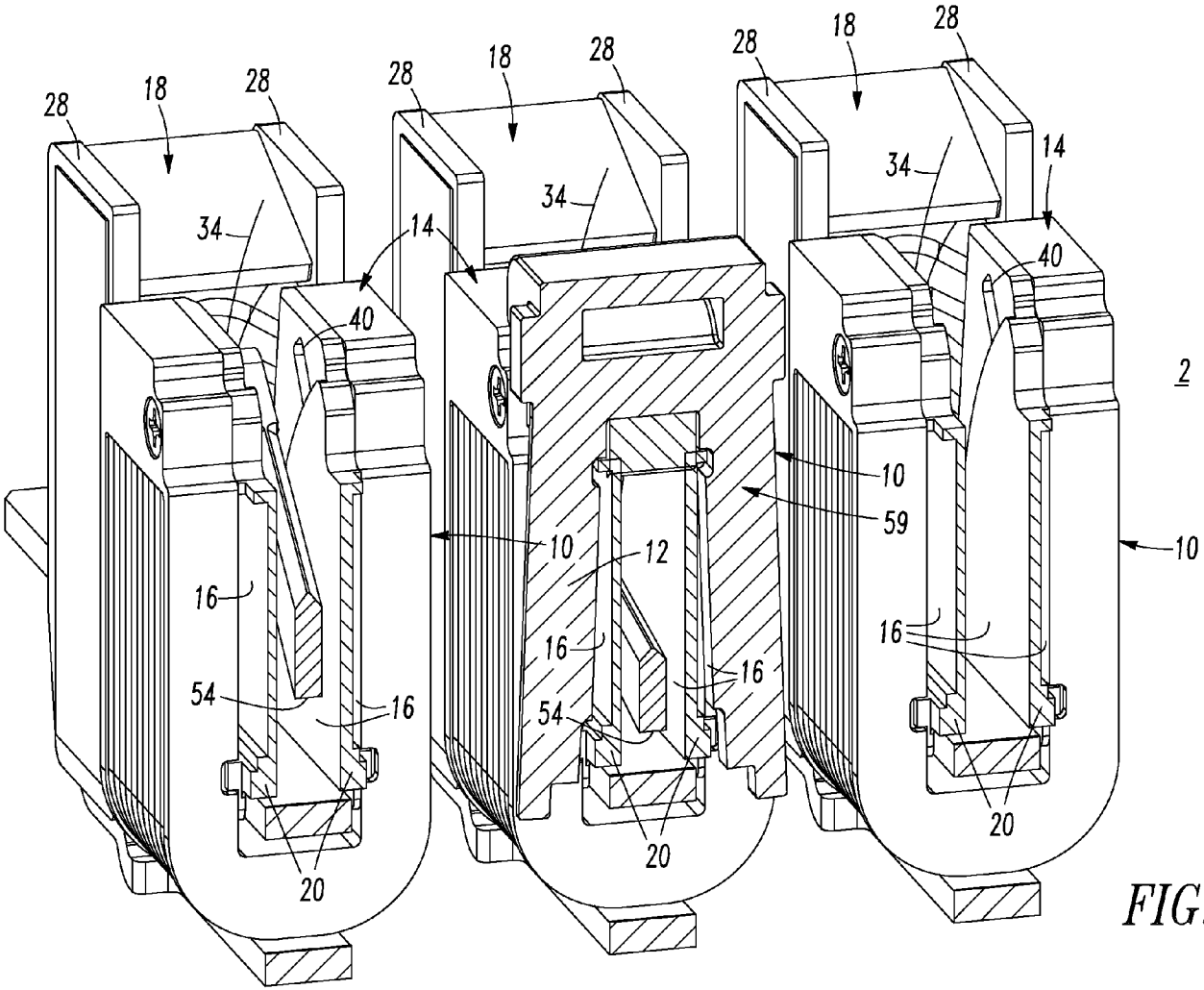
FIG. 4 is a cross sectional view along lines 4-4 of FIG. 3 showing the full elevation of each of the slot motors.

As shown in FIG. 4, the core 12 and the slot motor housing 14 form a U-shaped single piece structure. As shown with the center pole, an arc chamber barrier 59 is structured to block debris from going into the operating mechanism 6 (FIG. 7).

Example 15

Alternatively, the core 12 and the slot motor housing 14 can form a split core structure.

Example 16

FIGS. 5 and 6 are isometric views of the gassing inserts 20 of FIG. 1. As shown in FIGS. 2 and 4, a gas circulation channel 60 for the upper (with respect to FIG. 2) gas flow circulation path 22 is formed between an opening 62 between the slot motor housing side wall 44 and the gassing insert 20 and the gas circulation vent 40 (FIG. 7).

Another gas circulation channel 64 for the center (with respect to FIG. 2) gas flow circulation path 22 is formed between the opening 62 between the slot motor housing side wall 44 and the gassing insert 20 and the first end 48 of the gassing insert 20 (as best shown in FIG. 2).

It will be appreciated that each of the example gassing inserts 20 cooperates with a corresponding one of the slot motor housing side walls 44,46 to form the two example gas circulation channels 60,64, although the lower (with respect to FIG. 2) gassing inserts 20 and the lower (with respect to FIG. 2) slot motor housing side walls 46 form mirror images of the gas circulation channels 60,64.

The disclosed concept effectively cools a relatively hot arc plasma region across the separable contacts 4 after current zero. This cools the separable contact surface region using a number of gas flow circulation paths 22 strategically located in the arc chamber 8. For example and without limitation, this successfully enables relatively small frame molded case circuit breakers to interrupt 10 kA/600 VAC single-phase.

The disclosed concept is expected to not only increase the cooling during interruption and dielectric recovery after current zero, but also to release pressure build-up during short circuit interruption due to the increased gas flow.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An arc chamber comprising:

a slot motor comprising a core and a housing having an opening therein;

an arc chute; and a number of gassing inserts disposed in the opening of the housing, wherein the number of gassing inserts and the housing are structured to form a number of gas flow circulation paths, and wherein the number of gas flow circulation paths are structured to drive an arc into the arc chute, wherein the number of gassing inserts include two gassing inserts, wherein the number of gas flow circulation paths include a first gas flow circulation path and a second gas flow circulation path, wherein the housing and the two gassing inserts include a first end disposed away from the arc chute and an opposite second end disposed toward the arc chute, and wherein each of the first and second gas flow circulation paths circulates back toward the arc chute from a vent on a corresponding one of the two gassing inserts, the vent being located between the first end and the opposite second end of the corresponding one of the two gassing inserts.

2. The arc chamber of claim 1 wherein each of the two gassing inserts includes the vent structured to be located proximate a movable contact in an open position thereof

3. The arc chamber of claim 1 wherein each of the two gassing inserts includes the vent structured to be located proximate a stationary contact.

4. The arc chamber of claim 1 wherein the core and the housing form a U-shaped single piece structure.

5. The arc chamber of claim 1 wherein the core and the housing form a split core structure.

6. The arc chamber of claim 1 wherein the two gassing inserts are made of cellulose filled melamine formaldehyde.

7. The arc chamber of claim 1 wherein one of the first and second gas flow circulation paths is structured to be directed toward one of a movable contact and a stationary contact, in order to reduce metal vapor concentration about a contact region between the movable contact and the stationary contact.

8. The arc chamber of claim 1 wherein the housing of the slot motor further has a first side and an opposite second side facing the first side; wherein the two gassing inserts are a first gassing insert disposed at the first side of the housing and a second gassing insert disposed at the opposite second side of the housing; wherein the first gassing insert and the first side of the housing are structured to form the first gas flow circulation path; and wherein the second gassing insert and the opposite second side of the housing are structured to form the second gas flow circulation path.

9. The arc chamber of claim 8 wherein the arc chute comprises two side walls and a plurality of plates including a plurality of legs proximate the two side walls; wherein a pair of the legs defines a U-shaped opening of a corresponding one of the plates; and wherein the two gassing inserts extend into the U-shaped opening and cover a portion of the plates proximate the two side walls, in order to prevent arc erosion of the pair of legs.

10. An electrical switching apparatus comprising:

separable contacts;

an operating mechanism structured to open and close said separable contacts; and an arc chamber comprising:

a slot motor comprising a core and a housing having an opening therein, an arc chute, and a number of gassing inserts disposed in the opening of the housing, wherein the number of gassing inserts and the housing are structured to form a number of gas flow circulation paths, and wherein the number of gas flow circulation paths are structured to drive an arc into the arc chute, wherein the number of gassing inserts include two gassing inserts, wherein the number of gas flow circulation paths include a first gas flow circulation path and a second gas flow circulation path, wherein the housing and the two gassing inserts include a first end disposed away from the arc chute and an opposite second end disposed toward the arc chute, and wherein each of the first and second gas flow circulation paths circulates back toward the arc chute from a vent on a corresponding one of the two gassing inserts, the vent being located between the first end and the opposite second end of the corresponding one of the two gassing inserts.

11. The electrical switching apparatus of claim 10 wherein the operating mechanism comprises a movable contact arm, which is movable within the opening of the housing of the slot motor; and wherein the movable contact arm has a width of about 0.080 inch, in order to increase speed of movement thereof to improve current limiting and to reduce arc energy inside the arc chamber during opening of the separable contacts.

12. The electrical switching apparatus of claim 10 wherein the operating mechanism comprises a movable contact arm; wherein the separable contacts comprise a movable contact carried by the movable contact arm and a stationary contact electrically connected to a stationary conductor; and wherein both of the movable contact arm and the stationary conductor are coated with an arc-proof insulating paint.

13. The electrical switching apparatus of claim 10 wherein the operating mechanism comprises a movable contact arm; wherein the separable contacts comprise a movable contact carried by the movable contact arm and a stationary contact;

and wherein the two gassing inserts include the vent providing one of the first and second gas flow circulation paths, said vent being located proximate the movable contact in an open position of the movable contact arm.

14. The electrical switching apparatus of claim 10 wherein the separable contacts comprise a movable contact and a stationary contact; and wherein the two gassing inserts include the vent providing one of the first and second gas flow circulation paths, said vent being located proximate the stationary contact.

15. The electrical switching apparatus of claim 10 wherein the operating mechanism comprises a movable contact arm; wherein the separable contacts comprise a movable contact carried by the movable contact arm and a stationary contact; and wherein both of the first and second gas flow circulation paths are directed toward at least one of the movable contact and the stationary contact, in order to reduce metal vapor concentration and facilitate dielectric recovery about a contact region between the movable contact and the stationary contact after current zero.

16. The electrical switching apparatus of claim 10 wherein the housing of the slot motor has a first side and an opposite second side facing the first side; wherein the first gassing insert is disposed at the first side of the housing; and wherein the second gassing insert is disposed at the opposite second side of the housing.

* * * * *